US005169183A

United States Patent [19]

Hallez

[11] Patent Number: 5,169,183

[45] Date of Patent: Dec. 8, 1992

[54] THREADED JOINT FOR DRILL ROD ELEMENTS

[75] Inventor: Charles P. Hallez, Tellin, Belgium

[73] Assignee: Diamant Boart Stratabit S.A., Belgium

[21] Appl. No.: 433,416

[22] Filed: Nov. 7, 1989

Related U.S. Application Data

[63] Continuation of Ser. No. 193,442, May 12, 1988, abandoned.

[30] Foreign Application Priority Data

May 12, 1987 [BE] Belgium ..... 8700512
May 12, 1987 [BE] Belgium ..... 8700513

[51] Int. Cl.[5] ..... F16L 25/00
[52] U.S. Cl. ..... 285/334; 403/343
[58] Field of Search ..... 265/333, 334; 403/343

[56] References Cited

U.S. PATENT DOCUMENTS

| | | | |
|---|---|---|---|
| 2,532,632 | 12/1950 | MacArthur | 285/334 X |
| 3,572,777 | 3/1971 | Blose et al. | 285/334 |
| 4,154,466 | 5/1979 | Simmons | 285/334 |
| 4,614,120 | 9/1986 | Fradin et al. . | |
| 4,687,368 | 8/1987 | Eklof et al. | 403/343 |

FOREIGN PATENT DOCUMENTS

| | | | |
|---|---|---|---|
| 857427 | 8/1981 | U.S.S.R. | 285/333 |

OTHER PUBLICATIONS

Shryne et al., "New Tool Joint Improves High Angle Drilling", six pages.
"American Petroleum Institute Publication", pp. 26–27.

*Primary Examiner*—Dave W. Arola
*Attorney, Agent, or Firm*—Sughrue, Mion, Zinn, Macpeak & Seas

[57] ABSTRACT

A threaded joint for coupling two drill rod elements includes a first drill rod element having at least one end thereof a male tapered helical threading with a cone opening angle greater than 1° and less than 3°. The threading has a constant pitch determining an angle of inclination of the decreasing helix as greater than 1° and less than 3° at the beginning of the helical threading. A second drill rod element has corresponding female tapered helical threading. Each tapered helical threading has primary and secondary shoulders on opposite ends thereof and a stand-off between the primary shoulders when the male and female tapered helical threading are manually fitted together. The male tapered helical threading has discharge grooves in an unthreaded zone for deflection of lines of force. The primary and secondary shoulders have a truncated cone shape, and the ratio between the cone opening angle and the angle of inclination of the helix at the beginning of the tapered helical threading is less than 2.

5 Claims, 2 Drawing Sheets

THREADED JOINT FOR DRILL ROD ELEMENTS

This is a continuation of Application Ser. No. 07/193,442, filed May 12, 1988 now abandoned.

BACKGROUND OF THE INVENTION

The present invention relates to a threaded joint for coupling, by screwing at the end, drill rod elements, one of which is equipped at least one end with tapered male threading having a cone opening angle of less than 3° and a constant threading pitch with a double screwing motion stop and of which the other is equipped with corresponding tapered female threading.

It is essential for the strength of threading used for drilling purposes to correspond at least to the static and dynamic forces of the line of rods in the hole to be drilled and to the additional stresses required during manoeuvres.

Thus, knowledge of the coefficient of safety allows the thread to be worked to its ultimate limit without difficulty when rescuing the line of drill rods.

Drilling can currently be carried out to a depth of 14,000 m.

SUMMARY OF THE INVENTION

The present invention proposes screw threading which is better adapted to the above-mentioned requirements in that it has, in particular, better performance under torque, thrust and traction and fatigue under simple or compound stresses.

The appearance in drilling machinery of new cutting tools such as diamond-studded plates or polycrystalline diamond-studded cutting elements has led to the use of turntables which are more powerful and are capable of transmitting higher torques both in size and speed of rotation, sometimes despite considerable deviations imposed by guided drilling operations.

These new requirements impose extremely harsh stresses on the drill rods and, in particular, on the screw threaded joints, both with regard to the stresses of shearing, torsion, traction, bending and compression and with regard to the phenomena of fatigue of the screw-threaded member.

Truncated cone shaped rod elements provided with threading and comprising at least one screwing motion limiting stop, against which the end of a male element rests when tightened, are currently used when drilling for oil.

The distance kept between the external male stop for limiting the screwing motion and the external female stop for limiting the screwing motion, after manually tightening the male thread, constitutes the stand-off. The end of the thread is optionally provided with a discharge groove intended to deflect the lines of force.

This distance is calculated such that an excessive tightening torque produces a rigid assembly without causing permanent deformation either in the male connecting piece or in the female element.

Threading having slight conicity allows a large stand-off in relation to the cone angle.

The truncated cone shaped threading of the male element and that of the female element having a stand-off act, by their nature, as hoops. By screwing one in the other, radial stresses are exerted in the region of the threading and tend to reduce the diameter of the male element threading and to increase the diameter of the female element threading. Various factors, for example, the machining tolerances, the mechanical characteristics of the grease and the length of the stand-offs, influence the torque which has to be applied to the rods in order to bring into contact the screwing motion limiting stops.

The recommended torque load is that which allows the screwing motion limiting stops to be brought against one another with the desired pressure.

This known threading, as does all the standardised threading used nowadays for transmitting a moment in drilling, respects the concepts defined by the A.P.I., the American Petroleum Institute, in a simple manner.

Various types are very well known to oil drillers, in particular the Regular, Full Hole and Internal Flush types which comprise approximately 4 to 6 threads per inch (T.P.I.). They resist very high pulling forces and have a simple stop and cone opening angle of about 8° to 15° and a relatively small pitch, selected such that the ratio between the cone opening angle and the average angle of inclination of the helix is between 8/1 and 18/1. This standardised A.P.I. threading has the disadvantage of concentrating the moment-transmitting stresses on a piece of material of which the length does not exceed two pitches.

It should be noted that other types of threading also exist in oil and mineral drilling, in particular those used in core barrels. These types satisfy the A.P.I. recommendation of having the greatest possible conicity compatible with the rod thickness and of having a relatively small pitch. To safeguard this A.P.I. recommendation, the designers have selected pitches of between 6 and 8 T.P.I.

The threads standardised by the A.P.I. as well as the threads of core barrels have the significant feature of being interchangeable with one another. While the commercial criterion of interchangeability prevails, the only method of increasing performance in terms of strength relative to a moment of a standard thread is to select a steel having a higher strength, that is to say a higher yield stress and break point. However, this choice contributes only a negligible improvement and consequently causes a reduction in the elongation and therefore a clearly reduced resistance to fatigue, in other words, the rod tolerates slighter deviations and will have a shorter service life.

The majority of the damage observed in lines of rods with A.P.I. threading under the harsh conditions of use demanded by the new drilling methods is localised in the immediate vicinity of the screwing motion limiting stops and is manifested in one of the following ways:

1. bulging of the bore zone of the female element in the vicinity of the external stop and simultaneous annular reinforcement of the male base by creep;
2. clean break of the brittle type of the male connecting piece body in the region of the last turn or of the bore zone adjacent to this turn and to the external stop;
3. clean break of the sleeve of the female element in the region of the starting turn of the threading or of the bored portion of the tube adjacent to the external stop;
4. clean break of the male connecting piece in the region of the beginning of the threading;
5. clean break of the female element in the region of the bored zone at the base of the threading;
6. deformation of the thread roots due to excessive tension or fatigue.

The object of the present invention is to overcome the above-mentioned disadvantages. For this purpose, it proposes a tapered, screw-threaded connection having the benefit of unexpected performance data. The gain in resistance to torsion results from the combination of a small cone angle of the order of 1 to 3 degrees and a large pitch. However, care should be taken to keep the tangent of the helix smaller than the coefficient of friction of 0.08 generally set forth by the American Petroleum Institute to ensure that the parts cannot be unscrewed and to increase the permitted load torque value of the joint.

The invention is based on the fact that, when the inclination of the threading is increased, the contribution of the threading to the transmission of a torque is also increased because the stops are less stressed.

By increasing the inclination of a threading, a larger volume of material is brought into play for a given threading profile.

These features and details of the invention as well as others will appear in the course of the following detailed description which refers to the following drawing illustrating a particular embodiment, given as a non-limiting example, of the invention.

DETAILED DESCRIPTION

By moving away from the A.P.I. theory and following a logic closer to current drilling requirements, a thread 2 having much higher torque and also higher resistance to fatigue has been created in the same thickness of rod 1, while keeping the other properties (pull capacity, imperviousness, etc.) at least equal to their present level.

The threading according to the invention can be of any profile, for example triangular, trapezoidal or round. This trapezoidal threading allows better centering due to the inclination of the flanks.

pressures due to the hooping effect of the stand-off which rests on the flanks of the thread profiles.

Figure 1:
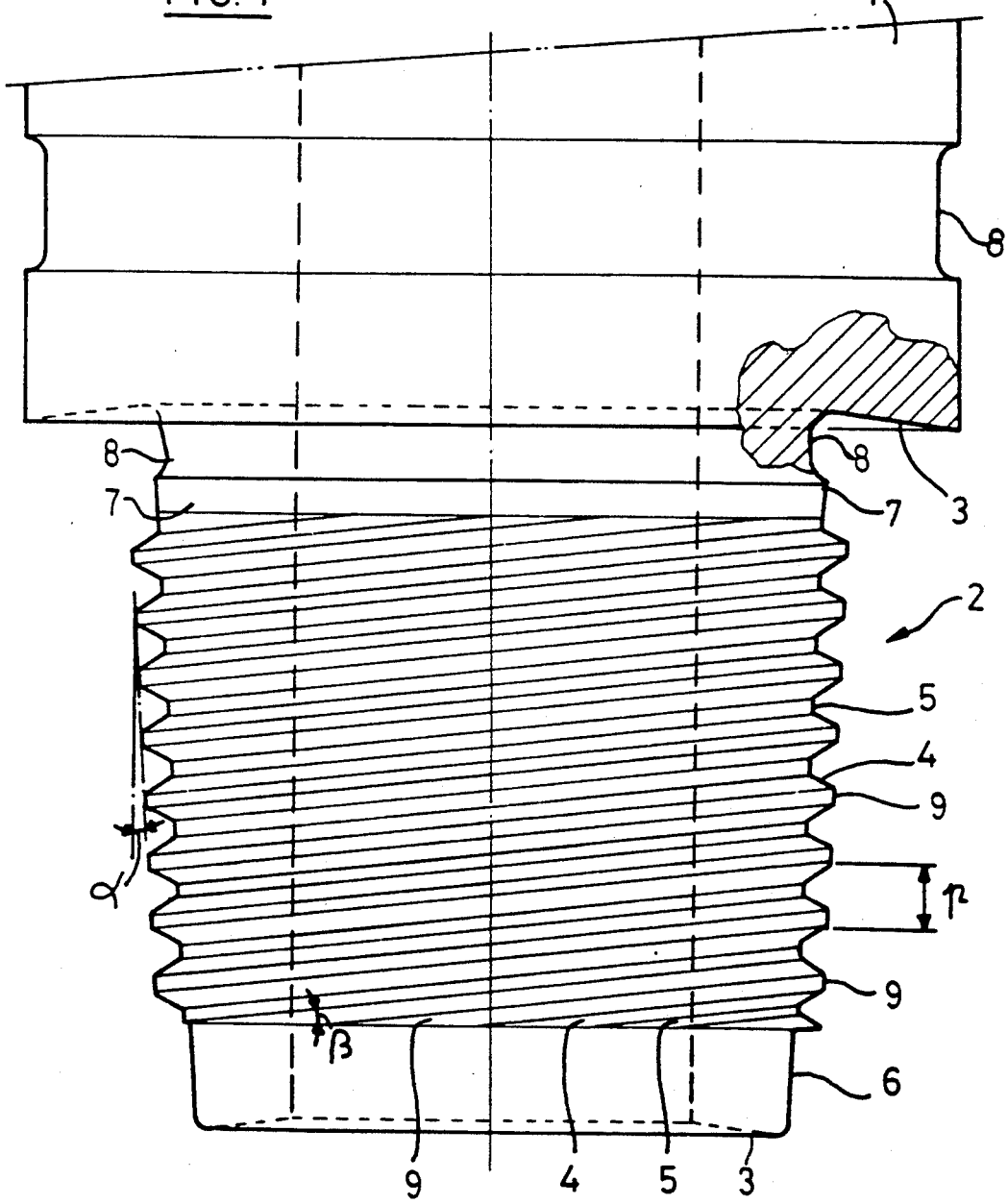
FIG. 1 is a partial longitudinal section through a drill rod element equipped with truncated cone shaped threading according to the invention and having a single beginning.

Suitable choice of the profile allows the threads to rest better on the flanks 4 and, for certain applications, on the root 5 of the threads. In fact, a hooping effect is induced on the upper face of the profile during the screwing motion while effects of pressure are created on the stops by the flanks of the profile. The flanks 4 facing the stops thus help to transmit the load torque. This load torque induces over the entire length of the threading a mechanical stress bias which prevents the phenomena of fatigue due to the repeated bending of the rods. The thread 2 also has a crest portion 9, as shown in FIG. 1.

It can easily be understood that a large pitch allows the stops to be stressed less for the same torque.

The combination of a small opening angle $\alpha$ and a large pitch allows the more demanding performance data required for current drilling operations to be attained.

Furthermore, a double stop 3 machined on either side of the threading in the limits of machining precision allowed by current machine tools and of elasticity of the thread is selected so as to double the surface area of the stops for limiting the screwing motion, in order to be able firstly to increase the mechanical performance of the line of rods, in particular the torque transmitted by the line of rods, and not to increase the impermeability of said line of rods.

Owing to the above-mentioned combination of an opening angle $\alpha$ of the order of 1° to 3° and an inclination $\beta$ of the helix of the order of 1° to 3° at the beginning of the threading, the torque strength value can be increased by more careful use of the material available to the thread and by distributing the forces over a larger volume of material. The performance of the new threading according to the invention is thus improved, relative to the known threading, in a proportion which may be as high as 270%, as illustrated by the following comparative example.

The comparative Table of a new $6\frac{3}{4}$ thread is given by way of example.

| | STANDARDISED THREAD | NEW THREAD A Single Beginning | COMPARATIVE FACTOR |
|---|---|---|---|
| Recommended load torque | 1300 kg.m. | 3490 kg.m. | 270% of the standardised |
| Breaking moment | 3055 kg.m. | 8200 kg.m. | 270% of the standardised |
| Maximum pull | 125 T | 193 T | 154% of the standardised |

The combination of a small opening angle $\alpha$ and a large pitch p relative to the diameter D of the rod 2 gives the threading unexpected performance data which are surprising in view of the weight of the rods.

$$p/D = tg\beta$$

$$\beta = 1 \text{ to } 3°.$$

It allows screwing at the end of the rod elements at the recommended load torque in only two or three turns.

It also allows the provision of stops 3 having a load bearing surface area sufficient to take up the high forces of pressure. Slight conicity allows better control of the This Table allows the new performance data to be evaluated. The measurements are the result of investigations to compare research and tests (analyses by finished elements, stress and deformation gauges . . . ). The most accurate and most high-performance measurements were taken on a torque testing stand.

The selection of a non-threaded introduction zone 6 having a length of at least two pitches between the first thread and the stop allows an increase in the quantity of steel working at a high level of stress and involving severe dynamic problems and significant inopportune locking.

Figure 2:
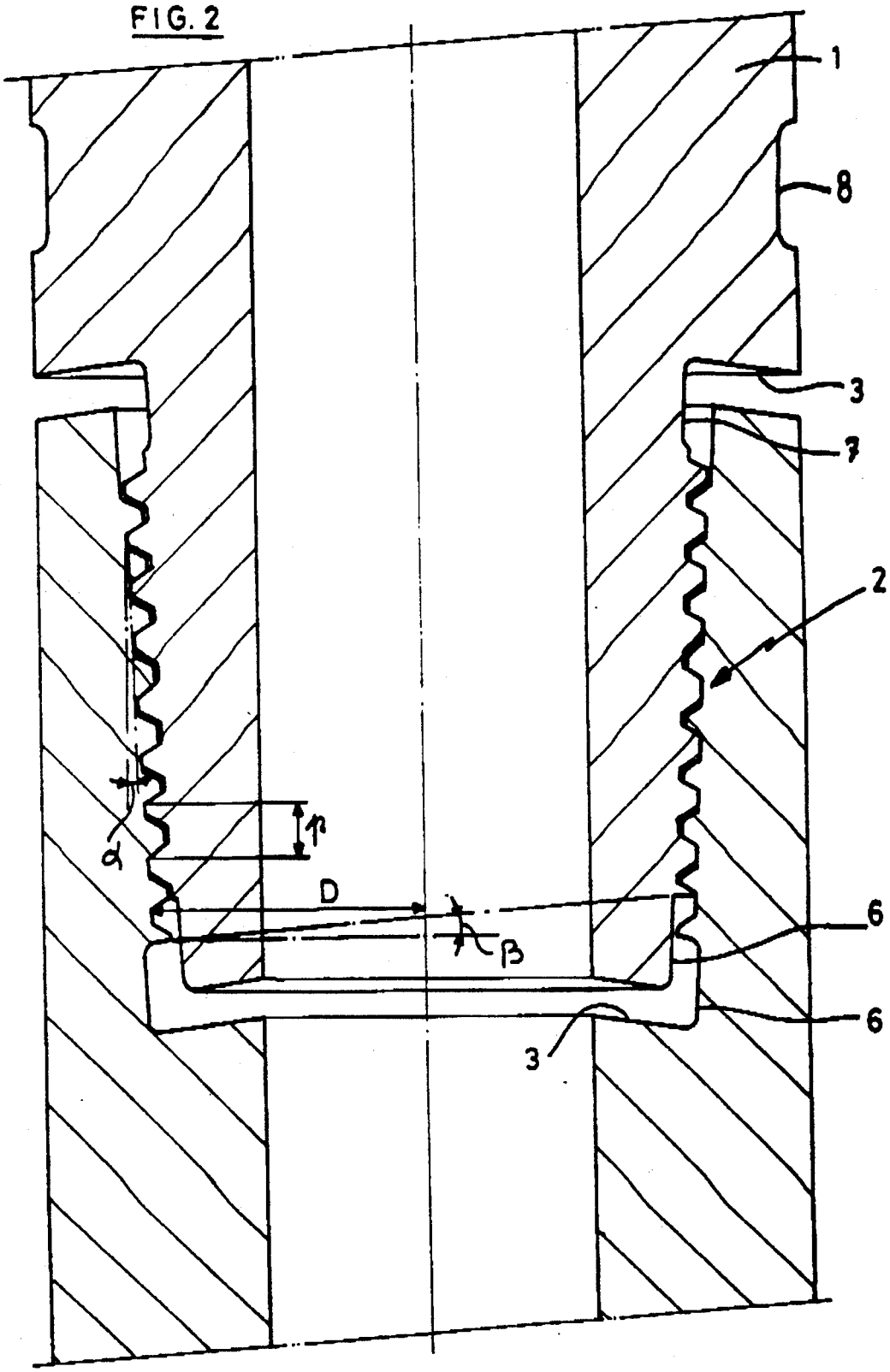
FIG. 2 shows a second embodiment of threading according to the invention.

The discharge grooves 8 provided in the dead zones 7 and in the rods in the vicinity of the connections and illustrated only in FIGS. 1 and 2 allow the fatigue stresses to be filtered and allow the thread to the protected. if they have suitable dimensions.

What we claim is:

1. A threaded joint for coupling, by screwing at their ends, two drill rod elements, said joint comprising:

a first drill rod element having at least one end thereof a male tapered helical threading with a cone opening angle ($\alpha$) greater than 1° and less than 3°, said threading having a constant pitch (p) determining an angle of inclination ($\beta$) of the decreasing helix as greater than 1° and less than 3° at the beginning of the helical threading; and a second drill rod element having corresponding female tapered helical threading;

wherein each said tapered helical threading includes:

primary and secondary shoulders on opposite ends of said tapered helical threading having a truncated cone shape, said primary shoulders of each of said male and female tapered helical threading being opposed externally of said joint, and said secondary shoulders of said male and female tapered helical threading being opposed internally of said joint when said male and female tapered helical threading are manually fitted together; and a stand-off, said stand-off being a distance between said primary shoulders when said male and female tapered helical threading are manually fitted tightly together;

wherein said male tapered helical threading has discharge grooves, one discharge groove being at an end of said male tapered helical threading between said primary shoulder and said male tapered helical threading adjacent an unthreaded zone of the male tapered helical threading in the vicinity of the coupling joint, and a second discharge groove being spaced from said male tapered helical threading on a side opposite said primary shoulder from said one discharge groove, said discharge grooves being for deflection of lines of force, and wherein the ratio between the cone opening angle ($\alpha$) and the angle of inclination ($\beta$) of the helix at the beginning of the tapered helical threading is less than 2.

2. A threaded joint according to claim 1, wherein said first drill rod element has an unthreaded space in the area of said one discharge groove between said primary shoulder and a last thread of said tapered helical threading, and a second unthreaded space between said secondary shoulder and a first thread of said male tapered helical threading, and wherein said second drill rod element has an unthreaded space between said primary shoulder and a first thread of said tapered helical threading, and a second unthreaded space between said secondary shoulder and a last thread of said female tapered helical threading, wherein said space is at least equal to a distance of two pitches.

3. A threaded joint according to claim 1, wherein a tangent of said angle of inclination ($\beta$) of the helix at the beginning of the helical threading is smaller than a friction coefficient of 0.08.

4. A threaded joint according to claim 1, wherein threading profiles of the male and female tapered helical threading have a crest and a root, and inclined flanks facing said primary and secondary shoulders of an opening angle ($\alpha$) of the helix which transmit screwing torque and which induce a mechanical stress bias over an entire length of the threading so as to prevent fatigue, wherein said crest and said root induce a hooping effect in an area of the threading profile during a screwing motion while pressure is transmitted to said primary and secondary shoulders by said inclined flanks of said profile.

5. A threaded joint according to claim 1, wherein a thread profile of said tapered helical threading is trapezoidal.

* * * * *